US007124752B2

(12) United States Patent
Bedkowski

(10) Patent No.: US 7,124,752 B2
(45) Date of Patent: Oct. 24, 2006

(54) DEFLECTOR FOR LIMITING THE INGRESS OF LIQUID OIL

(75) Inventor: Maciej Bedkowski, Peterborough (GB)

(73) Assignee: Perkins Engines Company Limited, Peterborough (GB)

( * ) Notice: Subject to any disclaimer, the term of this patent is extended or adjusted under 35 U.S.C. 154(b) by 29 days.

(21) Appl. No.: 10/830,235

(22) Filed: Apr. 23, 2004

(65) Prior Publication Data

US 2004/0255919 A1 Dec. 23, 2004

(30) Foreign Application Priority Data

Apr. 25, 2003 (EP) ..... 03252616

(51) Int. Cl.
*F01M 13/00* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,602,607 A * 7/1986 Balsley ..... 123/574
4,607,604 A * 8/1986 Kanoh et al. ..... 123/572
4,922,881 A * 5/1990 Tamba et al. ..... 123/572
4,958,613 A * 9/1990 Hiraoka et al. ..... 123/572
5,005,553 A * 4/1991 Washizu et al. ..... 123/572
5,135,348 A * 8/1992 Kishi et al. ..... 414/695.8
5,265,995 A * 11/1993 Beck ..... 414/694
5,417,184 A * 5/1995 McDowell ..... 123/41.86
5,617,834 A * 4/1997 Lohr ..... 123/572
6,322,104 B1 * 11/2001 Duppong et al. ..... 280/781
6,502,896 B1 * 1/2003 Nakata et al. ..... 296/190.05

FOREIGN PATENT DOCUMENTS

| | | |
|---|---|---|
| EP | 1 233 155 | 8/2002 |
| JP | 9-96209 | 4/1997 |
| WO | WO 03/025354 | 3/2003 |

OTHER PUBLICATIONS

European Search Report from European Application No. 03 25 2616 dated Oct. 10, 2003.
Patent Abstracts of Japan, Publication No. 2000045750, Feb. 15, 2000.
Machine Translation of Specification Publication No. 2000045750, at http://www4ipdl.jpo.go.jp/cgi-bin/fran_web_cgi_eiie, printed Nov. 26, 2003.
Patent Abstracts of Japan, Publication No. 03107517, May 7, 1991.

* cited by examiner

*Primary Examiner*—Marguerite McMahon
(74) *Attorney, Agent, or Firm*—Finnegan, Henderson, Farabow, Garrett&Dunner

(57) ABSTRACT

A system for limiting the ingress of oil into an induction feed pipe provided in the cylinder head cover of an internal combustion engine is disclosed. The system provides a cylinder head cover including a cylinder head cover outlet, a top plate spaced from the cylinder head cover outlet, and a perforated deflector plate. The top plate and deflector plate define a chamber in communication with the cylinder head cover outlet.

29 Claims, 4 Drawing Sheets

DEFLECTOR FOR LIMITING THE INGRESS OF LIQUID OIL

TECHNICAL FIELD

The present invention relates to closed circuit ventilation (CCV) systems for internal combustion engines. In particular, but not exclusively, the invention relates to a baffle provided in the top cover of an internal combustion engine to limit the ingress of liquid oil into the induction feed pipe.

BACKGROUND

An internal combustion engine typically has three chambers: the crankcase; the timing case; and the cylinder head cover. Each of these chambers must be openly connected to allow free flow of bypass gases and air movement during engine running.

In the engine, blow-by gas can escape past the piston into the crankcase where it mixes with airborne oil droplets. Rather than simply venting the blow-by gas to atmosphere, a closed breather system can be provided so that the blow-by gas is fed back into the engine induction system. This reduces the emission of unwanted gases.

It is desirable to include, in the breather system, means to retrieve oil contained in the blow-by gas and return this to the engine lubricating oil system for re-use. Otherwise the liquid oil, if allowed to enter the engine induction system (oil carry-over), can cause fouling of such components as turbocharger compressor vanes and engine poppet valves. Also, the liquid oil can form carbon deposits on the valves which can be detrimental to the performance of the intake air system. In addition, there will be a reduction in the volume of oil available for lubricating and cooling purposes.

A baffle may be provided in the cylinder head cover of the engine to impede oil carry-over. While this may lead to satisfactory performance in most applications, a particular problem exists for the engines of excavating work machines. Hydraulic excavators typically have an upper assembly that houses the engine, and a lower drive assembly. The upper assembly is rotatable relative to the lower assembly. Rotational acceleration or deceleration of the upper assembly leads to significant splashing of the oil within the engine which can increase oil carry-over.

It is known to provide a baffle having a perforated portion to limit oil carry-over. Such an apparatus is disclosed in EP 1,030,038. The apparatus includes a perforated triangular conduit fluidly connected to the breather gas inlet so as to allow the breather gas inlet to be located within the crankcase of the engine.

The present invention is directed to solving one or more of the problems set forth above.

SUMMARY OF THE INVENTION

According to a first aspect of the present invention, there is provided a cylinder head cover comprising: a cylinder head cover outlet; a top plate spaced from the cylinder head cover outlet; and a perforated deflector plate. The top plate and deflector plate define a chamber in communication with the cylinder head cover outlet.

According to a second aspect of the present invention, there is provided a deflector comprising: a cylinder head cover outlet; a baffle plate at least partially defining a fluid passage; and a perforated deflector plate interposing the cylinder head cover outlet and fluid passage.

According to a third aspect of the present invention, there is provided an internal combustion engine including a deflector in accordance with the second aspect of the invention.

According to a fourth aspect of the present invention, there is provided a method of limiting the ingress of liquid oil into a cylinder head cover outlet of an internal combustion engine. The method comprises the steps of: providing a top plate spaced from the cylinder head cover outlet; and providing a perforated deflector plate such that the top plate and deflector plate define a chamber in communication with the cylinder head cover outlet.

BRIEF DESCRIPTION OF THE DRAWINGS

An embodiment of the present invention will now be described, by way of example only, with reference to the accompanying drawings, in which.

DETAILED DESCRIPTION

Figure 1:
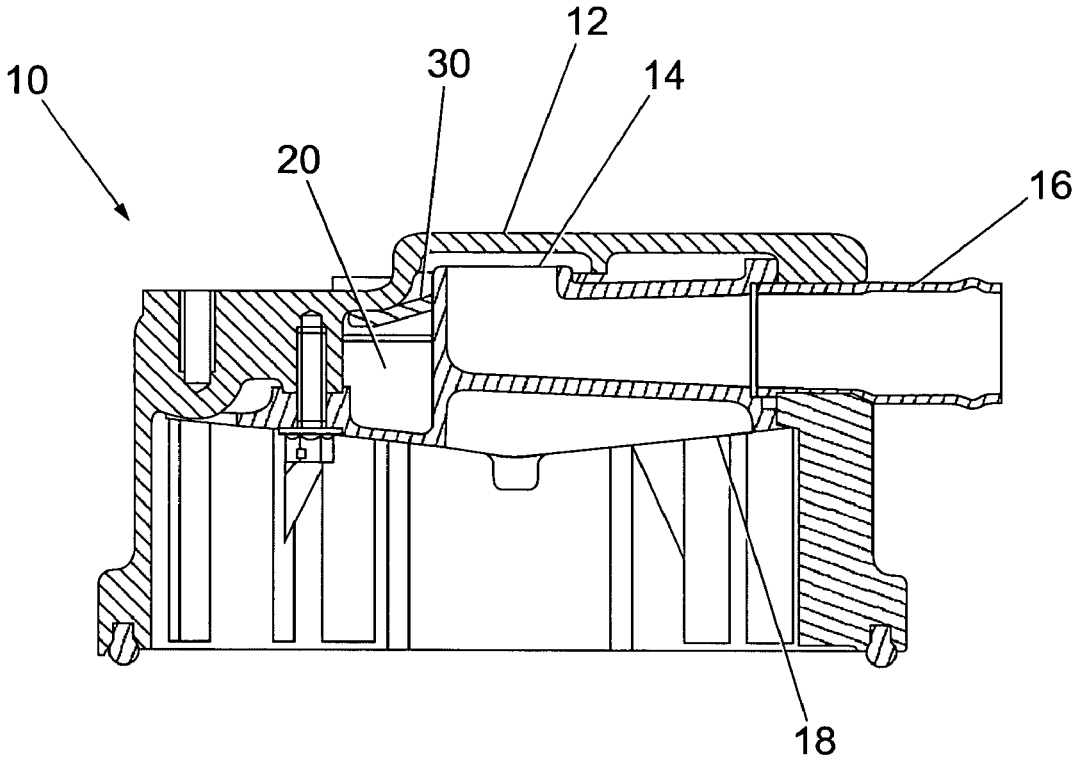
FIG. 1 shows a sectional side view of a cylinder head cover according to a first aspect of the present invention.

Referring to FIG. 1, there is shown a cylinder head cover 10 according to a first aspect of the present invention. The cylinder head cover 10 includes a top plate 12 which, in this embodiment, is the undersurface of the uppermost portion of the cylinder head cover 10. Spaced from the top plate 12 is a cylinder head cover outlet 14, which is connected to a conduit 16.

The conduit 16 is typically fluidly connected to one or more devices (not shown) which are fluidly connected to the engine induction system (not shown). These devices may include a CCV shut-off valve, a pressure regulating valve and an oil separator.

The cylinder head cover 10 includes a baffle plate 18. The baffle plate 18 partially defines a fluid passage 20 for blow-by gas, and the fluid passage 20 is fluidly connected to the cylinder head cover outlet 14. The baffle plate 18 inhibits oil 22 from splashing onto the underside of the cylinder head cover 10 in the region of the cylinder head cover outlet 14, and from falling into the cylinder head cover outlet 14. A perforated deflector plate 30 is provided at the baffle plate 18.

Figure 2:
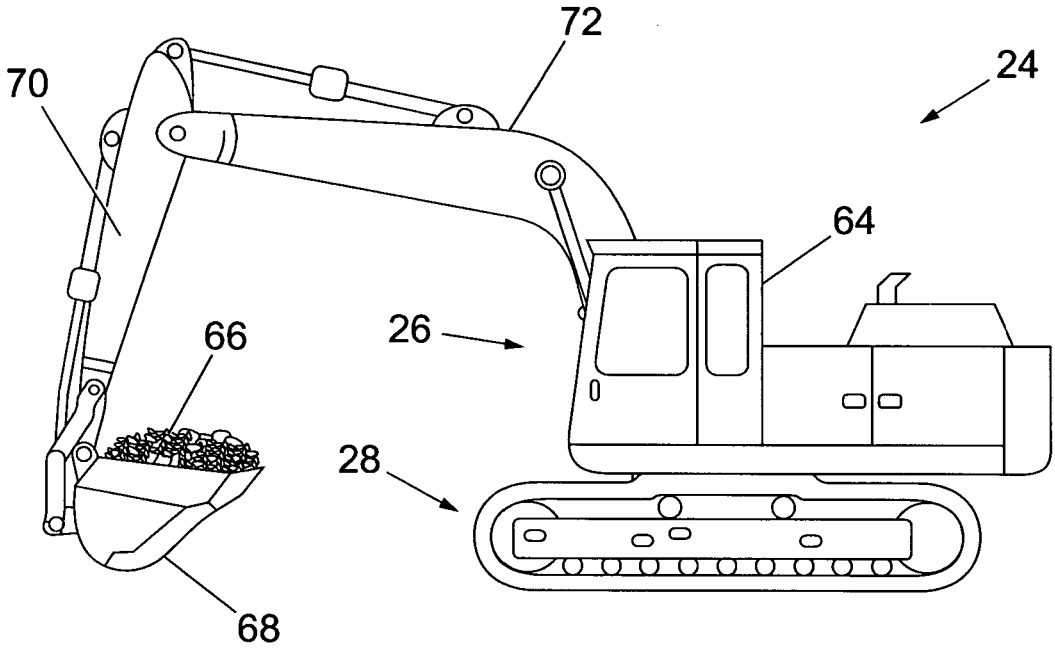
FIG. 2 shows a side view of an excavating work machine.

FIG. 2 shows one application for a cylinder head cover 10 according to the present invention. The invention is provided within the engine of an excavating work machine 24. The excavator 24 has an upper assembly 26 which houses the engine, and a lower drive assembly 28. The upper assembly 26 rotates relative to the lower assembly 28. The illustrated excavator is a track type excavator but the present invention is applicable to wheeled excavators and other work machines.

Figure 3:
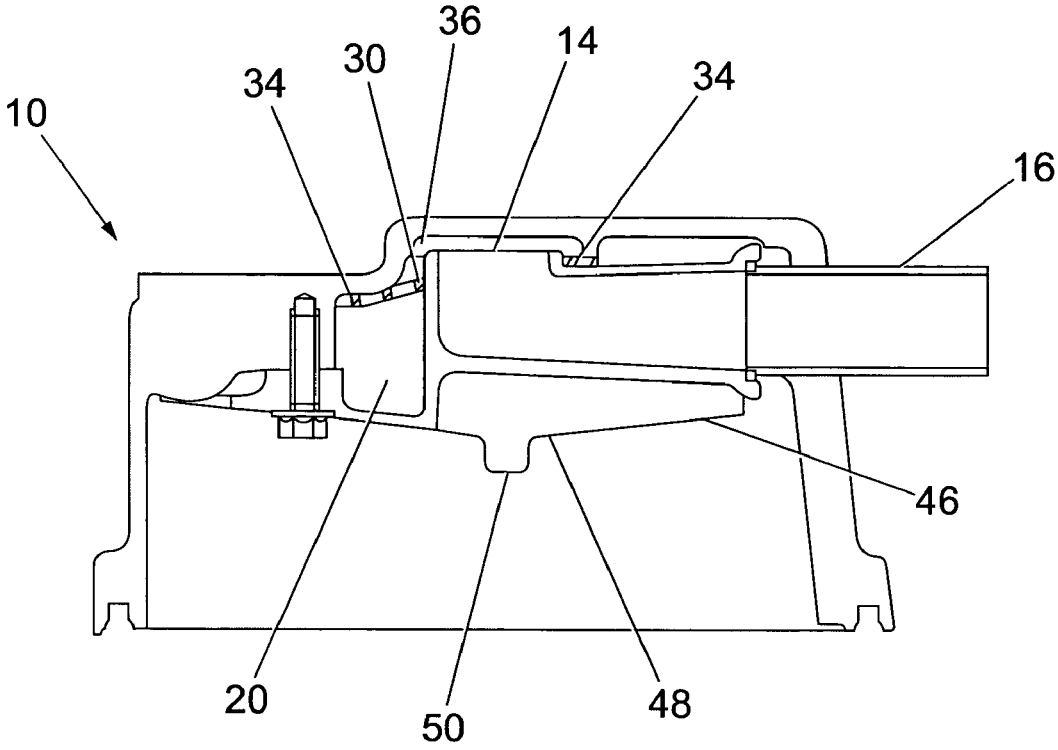
FIG. 3 shows a partial sectional view on line III—III of FIG. 5 of a deflector according to a second aspect of the present invention.
Figure 5:
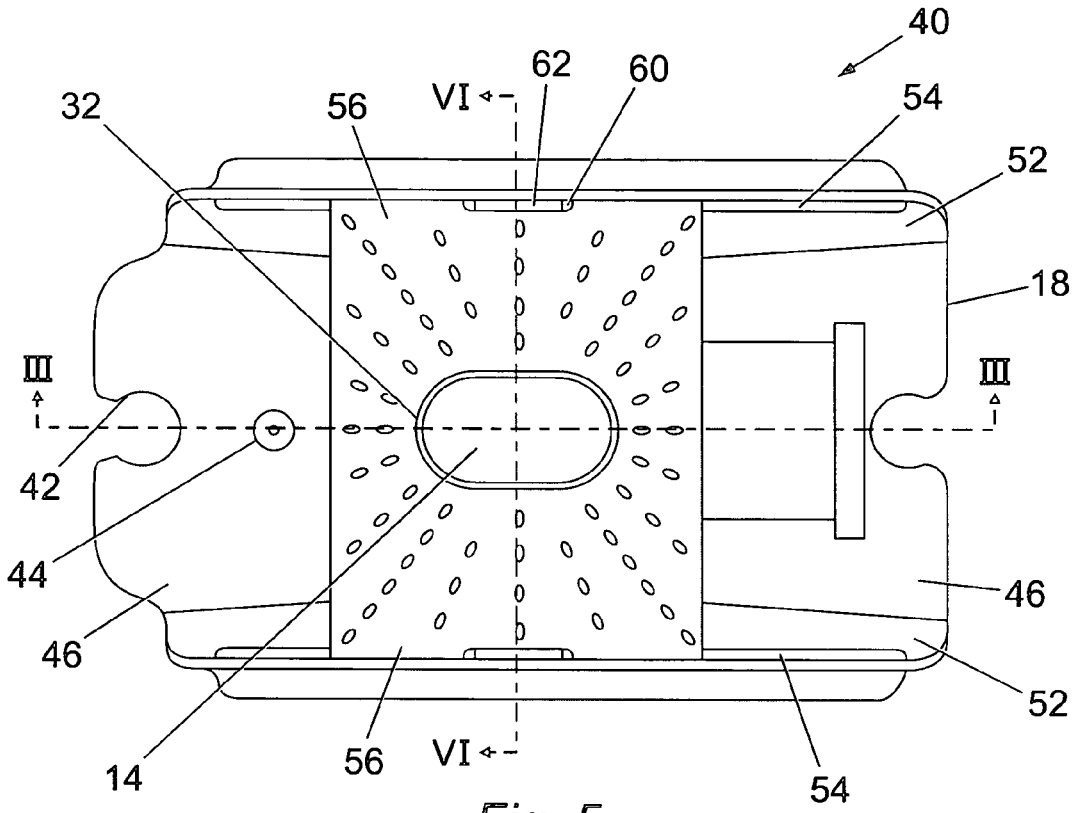
FIG. 5 shows a plan view of a deflector according to a second aspect of the present invention.

FIG. 3 also shows a cylinder head cover 10 in accordance with a first aspect of the present invention. As shown in FIG. 5, the deflector plate 30 includes a central aperture 32 for receiving the cylinder head cover outlet 14. The deflector plate 30 extends radially outwards from the cylinder head cover outlet 14 and a portion 34 of the upper surface of the deflector plate 30 makes contact with portions of the top plate 12. The top plate 12 and deflector plate 30 therefore define a chamber 36 which is in fluid communication with the cylinder head cover outlet 14.

Figure 4:
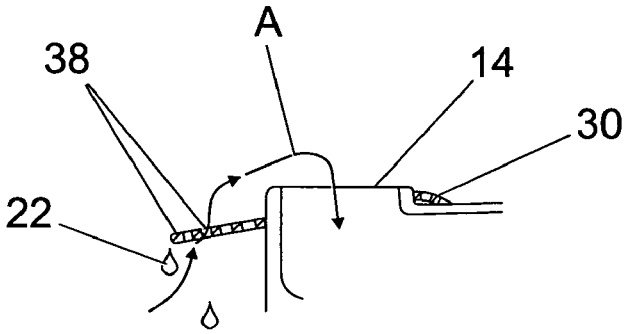
FIG. 4 shows a detailed sectional side view of a deflector plate of the deflector of FIG. 5.

Blow-by gas is transported to the fluid passage 20 from a closed breather system (not shown). As the deflector plate 30 interposes the fluid passage 20 and chamber 36, the blow-by gas must pass through a perforation 38 of the deflector plate 30 in order to enter the chamber 36 and, from there, the cylinder head cover outlet 14. One such pathway for the blow-by gas is shown by arrow 'A' in FIG. 4. Droplets of liquid oil 22 which are interspersed within the blow-by gas will tend to be deflected by the deflector plate 30.

Figure 6:
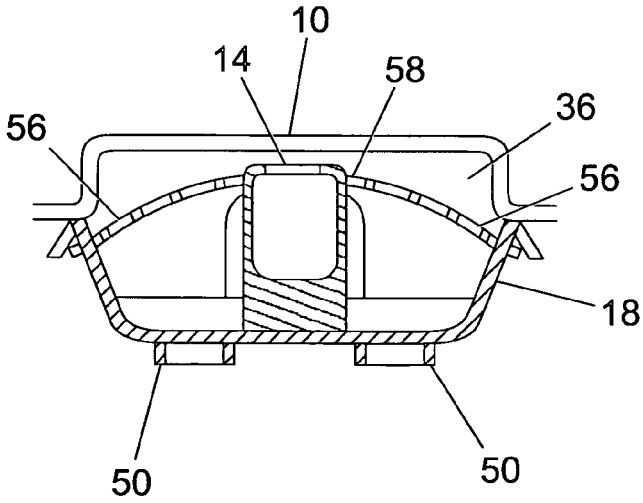
FIG. 6 shows a sectional view on line VI—VI of FIG. 5.

FIGS. 5 and 6 shows a deflector 40 in accordance with a second aspect of the present invention. It can be seen that the cylinder head cover outlet 14 is formed integrally with the baffle plate 18. The cylinder head cover outlet 14 and baffle plate 18 are formed from a plastic material.

The baffle plate 18 is positioned underneath the cylinder head cover outlet 14 and is connected to the underside of the cylinder head cover 10 shown diagrammatically in FIG. 6 on either side of the cylinder head cover outlet 14. The baffle plate 18 includes notches 42 and an aperture 44 for mounting the deflector 40 within the engine. The baffle plate 18 has base members 46 which are each inclined downwards towards a central portion 48. Liquid oil 22 that has been deflected will therefore tend to flow towards the central portion 48. The baffle plate 18 also includes slots 50 provided at the central portion 48 to allow the drainage of liquid oil 22 that has been deflected. The baffle plate 18 further includes side members 52 which have longitudinal slots 54.

The deflector plate 30 is formed from a plastic material which provides a suitable degree of resilience. Each longitudinal end 56 of the deflector plate 30 curves downwards from the central portion 48 of the deflector plate 30 to be received in the corresponding slot 50 of the baffle plate 18. The deflector plate 30 is therefore arcuate. Slots 60 provided at the longitudinal end 56 of the deflector plate 30 mate with webs 62 provided at the side members 52 of the baffle plate 18 to assist in locating the deflector plate 30.

INDUSTRIAL APPLICABILITY

A closed breather system transports blow-by gas from the engine crank case (not shown) to the cylinder head cover 10. The blow-by gas may then enter the cylinder head cover outlet 14 to be fed back into the engine induction system (not shown).

The cylinder head cover 10 according to the present invention includes a baffle plate 18 to limit the ingress of liquid oil 22 into the cylinder head cover outlet 14. Whilst the provision of the baffle plate 18 is sufficient in most applications, liquid oil 22 can still reach the cylinder head cover outlet 14 under certain circumstances. One example of this is within the engine of an excavating work machine 24 such as shown in FIG. 2.

The excavator 24 has an upper assembly 26 which houses the engine, hydraulic system and operator cab 64. The excavator 24 also has a lower drive assembly 28. The upper assembly 26 rotates relative to the lower assembly 28. The excavator 24 can carry large loads 66 in a bucket 68 which is connected at a distance from the centre of rotation of the excavator 24 via a stick 70 and boom 72. During rotational acceleration or deceleration of the upper assembly 26, significant splashing of the oil within the engine can occur. This can increase the occurrence of oil carry-over.

The provision of a deflector 40 which includes a deflector plate 30 further reduces the ingress of liquid oil 22 into the cylinder head cover outlet 14. As the deflector plate 30 interposes the fluid passage 20 and chamber 36, the blow-by gas must pass through a perforation 38 of the deflector plate 30 in order to enter the chamber 36 and, from there, the cylinder head cover outlet 14. Droplets of liquid oil 22 which are interspersed within the blow-by gas will tend to be deflected by the deflector plate 30, flow towards the central portion 48 of the baffle plate 18 and then fall through the drainage slots 50 towards the crank case.

The present invention provides means for limiting the ingress of liquid oil 22 into a cylinder head cover outlet 14 of an internal combustion engine. Liquid oil 22 that is contained within the blow-by gas is separated out and returned to the engine lubricating oil system for re-use.

This separation of liquid oil 22 prevents the oil from entering the engine induction system. Thus, fouling of engine components and the formation of carbon deposits on the valves is reduced or avoided. In addition, there is less of a reduction in the volume of oil available for lubricating and cooling purposes.

The present invention provides improved limiting of the ingress of liquid oil 22 into a cylinder head cover outlet 14 during extreme conditions. Such conditions include those that exist within the engine of an excavating work machine 24.

The present invention may be utilised for conventional engines with minimal modification required. The fluid connections to the engine induction system may still be provided at the top of the cylinder head cover 10. For existing engines or existing engine designs that include the baffle plate 18, the deflector plate 30 may easily be fitted.

Various modifications and improvements can be made without departing from the scope of the present invention. For instance, the size and shape of the deflector plate 30 may vary. The deflector plate 30 may not be arcuate. The size, number and arrangement of perforations 38 may also vary.

What is claimed is:

1. A deflector comprising:

a cylinder head cover outlet;

a baffle plate at least partially defining a fluid passage; and a perforated deflector plate disposed between the cylinder head cover outlet and fluid passage, each perforation of the deflector plate having an axis that extends completely through the plate from an upstream side to a downstream side of the deflector plate at an angle that is substantially perpendicular to the plate, the deflector plate including an aperture for receiving the cylinder head cover outlet.

2. A deflector as claimed in claim 1, wherein the baffle plate is configured to limit the ingress of liquid oil to the cylinder head cover outlet.

3. A deflector as claimed in claim 2, wherein the deflector plate is configured to limit the ingress of liquid oil to the cylinder head cover outlet.

4. A deflector as claimed in claim 1, wherein the deflector plate is attached to the baffle plate.

5. A deflector as claimed in claim 1, wherein the cylinder head cover outlet is formed integrally with the baffle plate.

6. A deflector as claimed in claim 1, wherein the baffle plate includes a drainage slot and one or more inclined members configured to direct deflected oil towards the drainage slot.

7. A deflector as claimed in claim 1, wherein the deflector plate is arcuate.

8. A deflector as claimed in claim 1, wherein the deflector plate is formed from a resilient material.

9. A deflector as claimed in claim 1, wherein the cylinder head cover outlet is oriented in an upward direction.

10. An internal combustion engine comprising:

a deflector including a cylinder head cover outlet;

a baffle plate at least partially defining a fluid passage; and a perforated deflector plate disposed between the cylinder head cover outlet and fluid passage, each perforation of the deflector plate having an axis that extends completely through the plate from an upstream side to a downstream side of the deflector plate at an angle that is substantially perpendicular to the plate, the deflector plate including an aperture for receiving the cylinder head cover outlet.

11. An internal combustion engine as claimed in claim 10, wherein the baffle plate is configured to limit the ingress of liquid oil to the cylinder head cover outlet.

12. An internal combustion engine as claimed in claim 11, wherein the deflector plate is configured to limit the ingress of liquid oil to the cylinder head cover outlet.

13. An internal combustion engine as claimed in claim 10, wherein the deflector plate is attached to the baffle plate.

14. An internal combustion engine as claimed in claim 10, wherein the cylinder head cover outlet is formed integrally with the baffle plate.

15. An internal combustion engine as claimed in claim 10, wherein the baffle plate includes a drainage slot and one or more inclined members configured to direct deflected oil towards the drainage slot.

16. An internal combustion engine as claimed in claim 10, wherein the deflector plate is arcuate.

17. An internal combustion engine as claimed in claim 10, wherein the deflector plate is formed from a resilient material.

18. An internal combustion engine as claimed in claim 10, wherein the cylinder head cover outlet is oriented in an upward direction.

19. A method of limiting the ingress of liquid oil into a cylinder head cover outlet of an internal combustion engine, the method comprising the steps of:

providing a top plate spaced from the cylinder head cover outlet; providing a perforated deflector plate such that the top plate and deflector plate define a chamber in communication with the cylinder head cover outlet, each perforation of the deflector plate having an axis that extends completely through the plate from an upstream side to a downstream side of the deflector plate at an angle that is substantially perpendicular to the plate; and receiving the cylinder head cover outlet in an aperture in the deflector plate.

20. The method of claim 19, including:

allowing passage of a blow-by gas through perforations in the perforated deflector plate; and limiting the ingress of at least a portion of liquid oil within the blow-by gas to the cylinder head cover outlet.

21. The method of claim 19, wherein the cylinder head cover outlet is oriented in an upward direction.

22. The method of claim 19, wherein the cylinder head cover outlet is formed integrally with a baffle plate.

23. The method of claim 19, including directing deflected oil towards a drainage slot with inclined members, the drainage slot being formed within a baffle plate.

24. A work machine, comprising:

a drive assembly;

an upper assembly connected to and rotatable relative to the drive assembly;

a boom assembly connected to the upper assembly and configured to receive a work tool; and the engine according to claim 10 housed within the upper assembly.

25. The work machine of claim 24, wherein the drive assembly is a lower drive assembly disposed below the engine.

26. The work machine of claim 24, wherein the baffle plate is disposed below the deflector plate, and wherein the deflector plate is attached to the baffle plate.

27. The work machine of claim 26, wherein the cylinder head cover outlet is formed integrally with the baffle plate.

28. The work machine of claim 26, wherein the baffle plate includes a drainage slot and one or more inclined members configured to direct deflected oil towards the drainage slot.

29. The work machine of claim 24, wherein the cylinder head cover outlet is oriented in an upward direction.

* * * * *